US006047485A

United States Patent [19]

Madyun

[11] Patent Number: 6,047,485

[45] Date of Patent: Apr. 11, 2000

[54] CUSTOM SALON NAIL DRYER

[76] Inventor: Atif S. Madyun, 1573 White Plains Rd., Bronx, N.Y. 10462

[21] Appl. No.: 09/164,645

[22] Filed: Oct. 1, 1998

[51] Int. Cl.[7] ..... F26B 19/00

[52] U.S. Cl. ..... 34/202

[58] Field of Search ..... 34/202

[56] References Cited

U.S. PATENT DOCUMENTS

| | | | |
|---|---|---|---|
| 3,864,847 | 2/1975 | Friedman et al. | 34/202 |
| 4,206,556 | 6/1980 | Sabo et al. | 34/90 |
| 5,280,679 | 1/1994 | Edelman | 34/202 |

*Primary Examiner*—Henry Bennett
*Assistant Examiner*—Malik N. Drake

[57] ABSTRACT

A finger nail dryer is provided including a housing having an upper surface and an extension for directing air over the upper surface. A fan assembly is mounted within the housing with a propeller coupled to a rotor of a motor. The motor is adapted to rotate the propeller upon the receipt of power thereby directing air to the extension for drying fingernails of a hand situated on the upper surface of the housing. A switch is connected between the motor and a battery. The switch has a first orientation for supplying the motor with power and a second orientation for precluding the supply of power to the motor. Finally, at least one hygienic cover is removably situated on the upper surface of the housing.

13 Claims, 2 Drawing Sheets

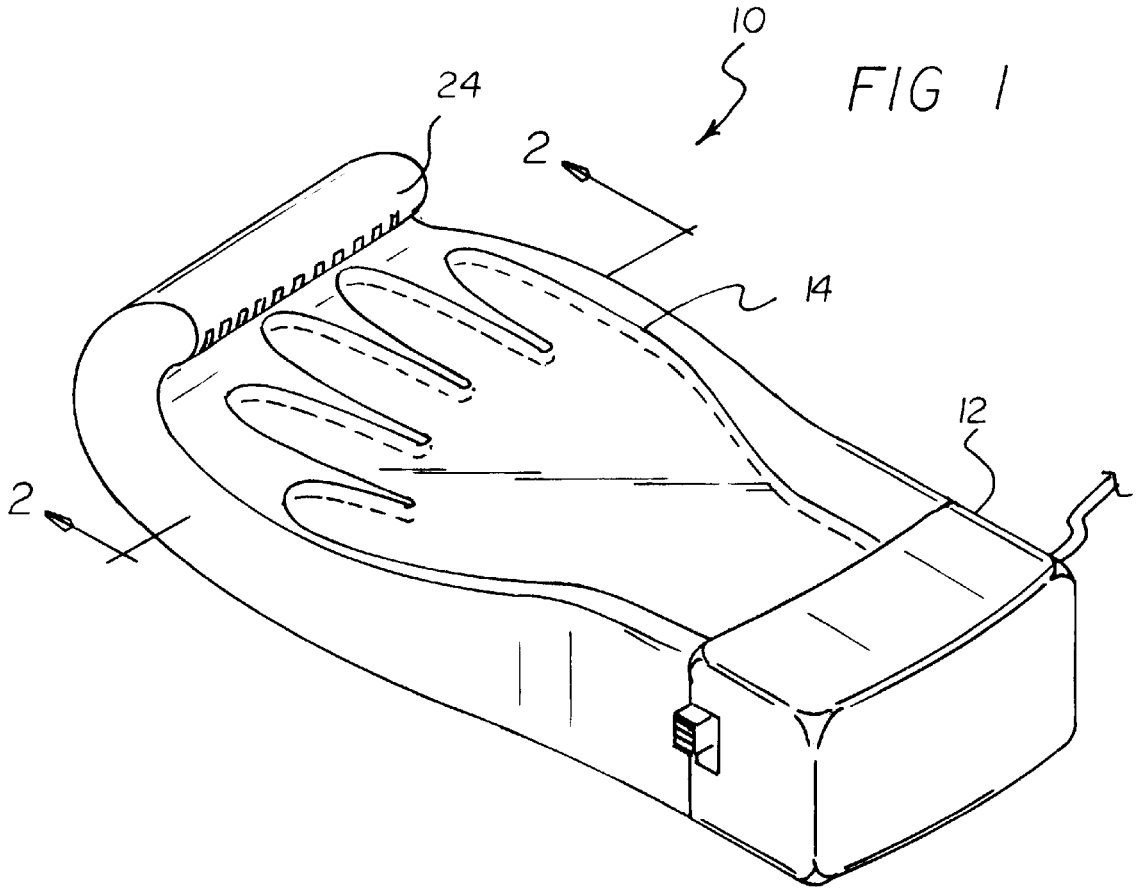
FIG 1
FIG 2
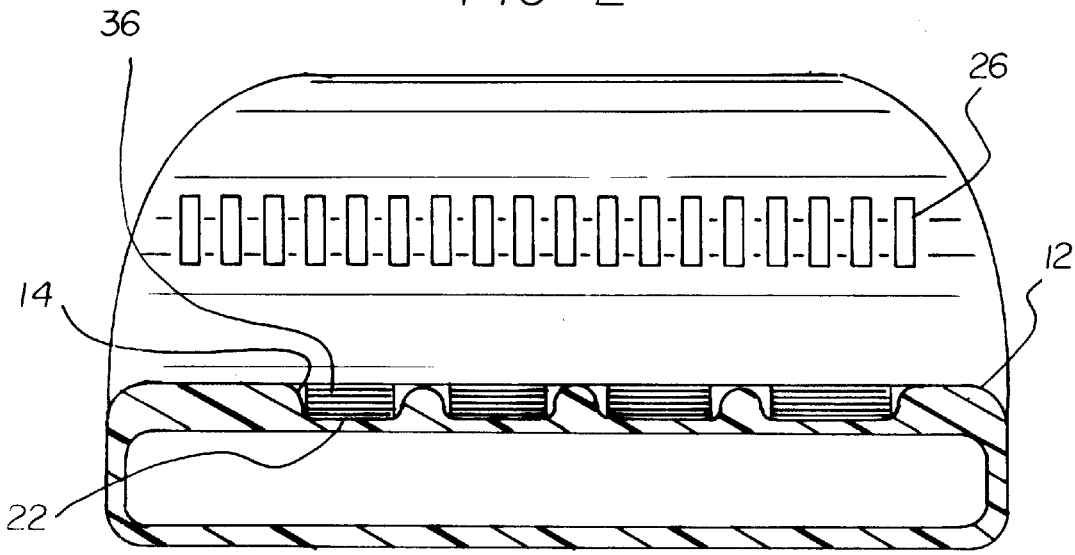

FIG 3
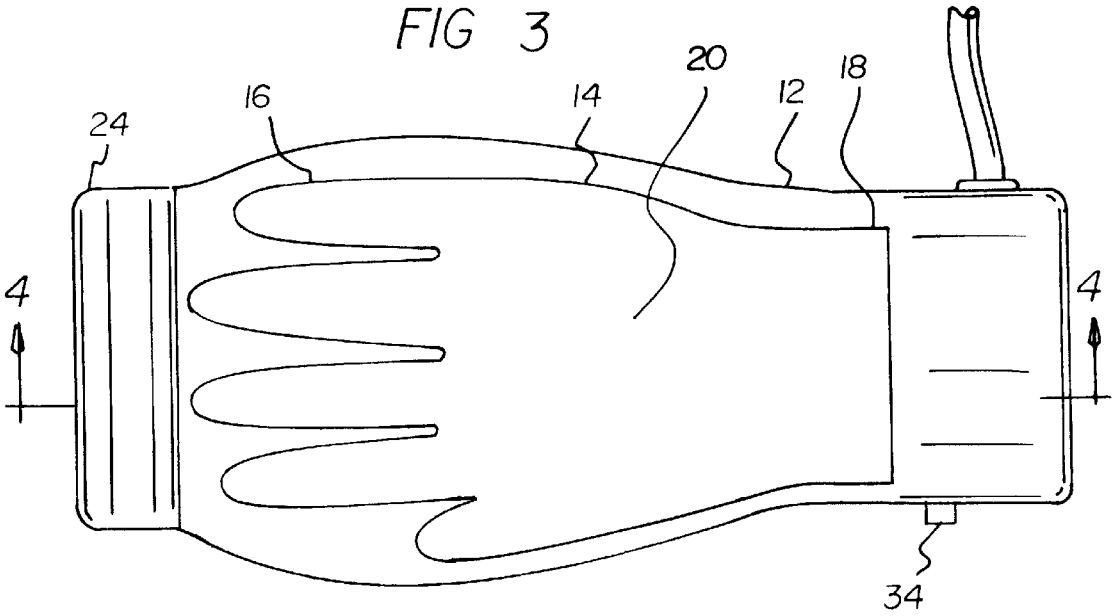
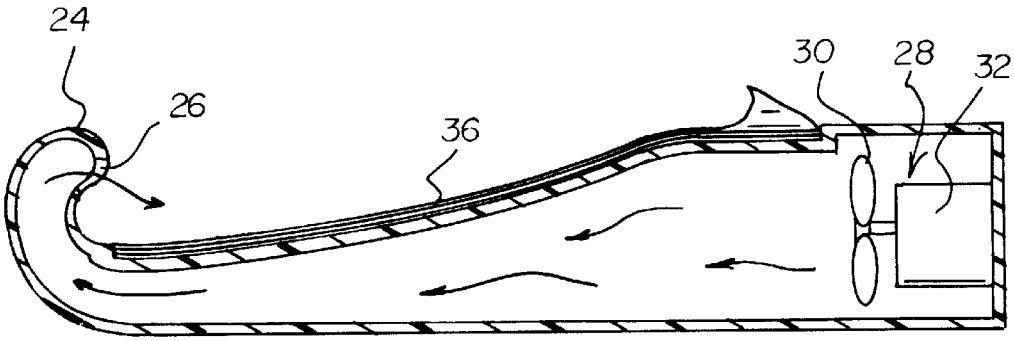
FIG 4

CUSTOM SALON NAIL DRYER

BACKGROUND OF THE INVENTION

1. Field of the Invention

The present invention relates to nail dryers and more particularly pertains to a new custom salon nail dryer for drying the nails of a user.

2. Description of the Prior Art

The use of nail dryers is known in the prior art. More specifically, nail dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art nail dryers include U.S. Pat. No. 4,754,769; U.S. Pat. No. 3,930,320; U.S. Pat. No. 5,280,679; U.S. Pat. No. 4,464,906; U.S. Pat. No. 4,706,556; and U.S. Patent Des. 279,412.

In these respects, the custom salon nail dryer according to the present invention substantially departs from the conventional concepts and designs of the prior art, and in so doing provides an apparatus primarily developed for the purpose of effectively drying the nails of a user.

SUMMARY OF THE INVENTION

In view of the foregoing disadvantages inherent in the known types of nail dryers now present in the prior art, the present invention provides a new custom salon naXXXXi wherein the same can be utilized for effectively drying the nails of a user.

The general purpose of the present invention, which will be described subsequently in greater detail, is to provide a new custom salon nail dryer apparatus and method which has many of the advantages of the nail dryers mentioned heretofore and many novel features that result in a new custom salon nail dryer which is not anticipated, rendered obvious, suggested, or even implied by any of the prior art nail dryers, either alone or in any combination thereof.

To attain this, the present invention generally comprises a housing having a generally rectangular planar lower surface, a rectangular planar rear surface, an upper surface, an open front and a pair of side faces defining an interior space. As shown in FIG. 4, the upper surface includes an inboard planar portion. An outboard sloping portion extends downwardly from the inboard planar portion to the open front of the housing. The upper surface has a hand-shaped recess formed therein, as best shown in FIG. 1. A plurality of finger indentations, a wrist indentation, and a palm indentation are formed in the upper surface to define the recess. Each indentation is equipped with a flat bottom surface for reasons that will become apparent later. As shown in FIG. 4, the housing has a hollow extension integrally coupled to the housing about the open front and in communication with the interior space. The hollow extension has a C-shaped vertical cross-section of a common size along an entire width thereof. A plurality of spaced vertically oriented slots are formed along an entire width of the extension. Such slots are directed toward an end of each of the finger indentations of the recess. FIG. 4 shows a fan assembly mounted within the housing on the rear face thereof. The fan assembly has a propeller facing the open front of the housing and coupled to a rotor of a motor. The motor serves to rotate the propeller upon the receipt of power. When the propeller is rotated, air is directed through the vents for drying fingernails of a hand situated within the recess formed in the housing. Situated on one of the side faces of the housing is a slider switch. Such switch is connected between the motor and a battery. The switch has a first orientation for supplying the motor with power and a second orientation for precluding the supply of power to the motor. Finally, a plurality of stacked hand-shaped hygienic covers are formed of plastic and removably situated within the recess of the housing. Each cover has an adhesive lining a lower surface thereof for maintaining the same in an operative orientation during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new custom salon nail dryer apparatus and method which has many of the advantages of the nail dryers mentioned heretofore and many novel features that result in a new custom salon nail dryer which is not anticipated, rendered obvious, suggested, or even implied by any of the prior art nail dryers, either alone or in any combination thereof.

It is another object of the present invention to provide a new custom salon nail dryer which may be easily and efficiently manufactured and marketed.

It is a further object of the present invention to provide a new custom salon nail dryer which is of a durable and reliable construction.

An even further object of the present invention is to provide a new custom salon nail dryer which is susceptible of a low cost of manufacture with regard to both materials and labor, and which accordingly is then susceptible of low prices of sale to the consuming public, thereby making such custom salon nail dryer economically available to the buying public.

Still yet another object of the present invention is to provide a new custom salon nail dryer which provides in the apparatuses and methods of the prior art some of the advantages thereof, while simultaneously overcoming some of the disadvantages normally associated therewith.

Still another object of the present invention is to provide a new custom salon nail dryer for effectively drying the nails of a user.

Even still another object of the present invention is to provide a new custom salon nail dryer includes a housing having an upper surface and an extension for directing air over the upper surface. A fan assembly is mounted within the housing with a propeller coupled to a rotor of a motor. The motor is adapted to rotate the propeller upon the receipt of power thereby directing air to the extension for drying fingernails of a hand situated on the upper surface of the housing. A switch is connected between the motor and a battery. The switch has a first orientation for supplying the motor with power and a second orientation for precluding the supply of power to the motor. Finally, at least one hygienic cover is removably situated on the upper surface of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new custom salon nail dryer according to the present invention.

FIG. 2 is a rear view of the present invention.

FIG. 3 is a top view of the present invention.

FIG. 4 is a side cross-sectional view of the present invention taken along line 4—4 shown in FIG. 3.

DESCRIPTION OF THE PREFERRED EMBODIMENT

With reference now to the drawings, and in particular to FIGS. 1 through 4 thereof, a new custom salon nail dryer embodying the principles and concepts of the present invention and generally designated by the reference numeral 10 will be described.

The present invention, as designated as numeral 10, includes a housing 12 having a generally rectangular planar lower surface, a rectangular planar rear surface, an upper surface, an open front and a pair of side faces defining an interior space. As shown in FIG. 4, the upper surface includes an inboard planar portion. An outboard sloping portion extends downwardly from the inboard planar portion to the open front of the housing. The slopping portion preferably has a length at least 3/4 that of the housing.

The upper surface has a hand-shaped recess 14 formed therein, as best shown in FIG. 1. A plurality of finger indentations 16, a wrist indentation 18, and a palm indentation 20 are formed in the upper surface to define the recess. Each indentation is equipped with a flat bottom surface 22 for reasons that will become apparent later. To accommodate the increased width of a central extent of the hand-shaped recess, the side faces of the housing are bulged outwardly in a curvilinear manner at a center thereof.

As shown in FIG. 4, the housing has a hollow extension 24 integrally coupled to the housing about the open front and in communication with the interior space. The hollow extension has a C-shaped vertical cross-section of a common size along an entire width thereof. Preferably, such width is equal to that of the planar inboard portion. An upper extent of the extension ideally only extends to, but doesn't overlap, a tip of the longest finger indentation. A plurality of spaced vertically oriented rectangular slots 26 are formed along an entire width of the extension. Such slots are directed toward an end of each of the finger indentations of the recess.

FIG. 4 shows a fan assembly 28 mounted within the housing on the rear face thereof. The fan assembly has a propeller 30 facing the open front of the housing and coupled to a rotor of a motor 32. The motor serves to rotate the propeller upon the receipt of power. When the propeller is rotated, air is directed through the vents for drying fingernails of a hand situated within the recess formed in the housing.

Situated on one of the side faces of the housing is a slider switch 34. Such switch is connected between the motor and an unillustrated battery. The switch has a first orientation for supplying the motor with power and a second orientation for precluding the supply of power to the motor.

Finally, a plurality of stacked hand-shaped hygienic covers 36 are formed of plastic and removably situated within the recess of the housing. Since the covers are hand-shaped, finger portions, a wrist portion, and a palm portion are defined. Each cover has an adhesive lining only a lower surface thereof for maintaining the same in an operative orientation during use. After the present invention is used by a first user, a top cover may be removed thereby exposing another cover for use by a second user. In the alternative, a single removable thick rigid cover may be employed to accomplish the purpose of the covers 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A finger nail dryer comprising, in combination:

a housing having a generally rectangular planar lower surface, a rectangular planar rear surface, an upper surface, an open front and a pair of side faces defining an interior space, the upper surface including an inboard planar portion and an outboard sloping portion extending downwardly from the inboard planar portion to the open front of the housing, the upper surface having a hand-shaped recess formed therein wherein a plurality of finger indentations, a wrist indentation, and a palm indentation are formed therein each with a flat bottom surface, the housing having a hollow extension integrally coupled thereto about the open front and in communication with the interior space, the hollow extension having a C-shaped cross-section and a plurality of spaced vertically oriented slots formed along an entire width thereof;

a fan assembly mounted within the housing on the rear face thereof, the fan assembly having a propeller facing the open front of the housing and coupled to a rotor of a motor the motor adapted to rotate the propeller upon the receipt of power thereby directing air through the vents for drying fingernails of a hand situated within the recess formed in the housing;

a slider switch situated on one of the side faces of the housing and connected between the motor and a battery, the switch having a first orientation for supplying the motor with power and a second orientation for precluding the supply of power to the motor; and a plurality of stacked hand-shaped hygienic covers formed of plastic and situated within the recess of the housing, each cover having an adhesive lining a lower surface thereof.

2. A finger nail dryer comprising:

a housing having an upper surface and an extension for directing air over the upper surface;

a fan assembly mounted within the housing, the fan assembly having a propeller coupled to a rotor of a motor, the motor adapted to rotate the propeller upon the receipt of power thereby directing air to the extension for drying fingernails of a hand situated on the upper surface of the housing;

a switch connected between the motor and a battery, the switch having a first orientation for supplying the motor with power and a second orientation for precluding the supply of power to the motor; and at least one hygienic cover removably situated on the upper surface of the housing;

wherein the upper surface of the housing has an outboard sloping portion extending downwardly from the inboard planar portion to the extension.

3. A finger nail dryer as set forth in claim 2 wherein each cover is formed of plastic.

4. A finger nail dryer as set forth in claim 2 wherein each cover has an adhesive lining a lower surface thereof.

5. A finger nail dryer as set forth in claim 2 wherein each cover is hand-shaped.

6. A finger nail dryer as set forth in claim 2 wherein the upper surface of the housing has a hand-shaped recess formed therein wherein a plurality of finger indentations, a wrist indentation, and a palm indentation are formed therein each with a flat bottom surface.

7. A finger nail dryer as set forth in claim 2 wherein the extension is integrally coupled to the housing in communication with the interior space, the hollow extension having a C-shaped cross-section and a plurality of spaced slots formed along an entire width thereof.

8. A finger nail dryer comprising:

a housing having an upper surface and an extension for directing air over the upper surface;

a fan assembly mounted within the housing, the fan assembly having a propeller coupled to a rotor of a motor, the motor adapted to rotate the propeller upon the receipt of power thereby directing air to the extension for drying fingernails of a hand situated on the upper surface of the housing;

a switch connected between the motor and a battery, the switch having a first orientation for supplying the motor with power and a second orientation for precluding the supply of power to the motor; and at least one hygienic cover removably situated on the upper surface of the housing;

wherein each cover has an adhesive lining a lower surface thereof.

9. A finger nail dryer as set forth in claim 8 wherein each cover is formed of plastic.

10. A finger nail dryer as set forth in claim 8 wherein each cover has an adhesive lining a lower surface thereof.

11. A finger nail dryer as set forth in claim 8 wherein each cover is hand-shaped.

12. A finger nail dryer as set forth in claim 8 wherein the upper surface of the housing has a hand-shaped recess formed therein wherein a plurality of finger indentations, a wrist indentation, and a palm indentation are formed therein each with a flat bottom surface.

13. A finger nail dryer as set forth in claim 8 wherein the extension is integrally coupled to the housing in communication with the interior space, the hollow extension having a C-shaped cross-section and a plurality of spaced slots formed along an entire width thereof.

* * * * *